US006722233B2

(12) United States Patent
I-He

(10) Patent No.: US 6,722,233 B2
(45) Date of Patent: Apr. 20, 2004

(54) PAWL SHIFTING DEVICE FOR A RATCHET TOOL

(76) Inventor: Liao I-He, 11F-2 No. 43, Chai-I Street, Taichung City (TW)

( * ) Notice: Subject to any disclaimer, the term of this patent is extended or adjusted under 35 U.S.C. 154(b) by 465 days.

(21) Appl. No.: 09/812,385

(22) Filed: Mar. 21, 2001

(65) Prior Publication Data

US 2003/0145688 A1 Aug. 7, 2003

(51) Int. Cl.[7] ..... B25B 13/46
(52) U.S. Cl. ..... 81/63.2; 192/43.1
(58) Field of Search ..... 81/58.4, 63, 63.2; 192/43.1, 43.2

(56) References Cited

U.S. PATENT DOCUMENTS 4,029,185 A * 6/1977 Walsh ..... 192/43.1
4,770,072 A * 9/1988 Neuhaus ..... 81/63
4,862,775 A * 9/1989 Chow ..... 81/63.2
5,000,066 A * 3/1991 Gentiluomo ..... 81/63
6,386,072 B1 * 5/2002 Yuan-Chin et al. ..... 81/63.2
6,457,388 B1 * 10/2002 Chen ..... 81/63.2
6,516,691 B1 * 2/2003 Wei ..... 81/63.2

* cited by examiner

*Primary Examiner*—James G. Smith
(74) *Attorney, Agent, or Firm*—Charles E. Baxley

(57) ABSTRACT

A ratchet tool includes a passage defined through the head of the tool and communicating with an interior of the head. A driving member is received in the head and is pivotally connected to a pawl which is engaged with a toothed member in the head. A first engaging member is located on the driving member and a bar movably extends through the passage. The bar has a second engaging member which is engaged with the first engaging member. The pawl is pivoted by pushing the bar.

15 Claims, 18 Drawing Sheets

PAWL SHIFTING DEVICE FOR A RATCHET TOOL

FIELD OF THE INVENTION

The present invention relates to a pawl shifting device for a ratchet tool and includes a bar engaged with the pawl directly or indirectly so that when users shift the bar, the pawl is pivoted.

BACKGROUND OF THE INVENTION

A conventional pawl shifting device for a ratchet tool generally includes a shifting lever pivotally connected to the pawl and the lever is accessible from an outside of the head of the ratchet tool. The pawl is pivoted to engage with the toothed member in the head of the ratchet tool by pivoting the lever. The engagement between the pawl and the lever is so simple and generally includes a ball biased a spring. The ball biased by the spring contacts the pawl at a point which is so weak that the lever can only provide a force to pivot the pawl, the engagement cannot provide a strong backup when a large torque is applied.

SUMMARY OF THE INVENTION

In accordance with one aspect of the present invention, there is provided a ratchet tool and comprising a head having two covers respectively connected to sides of the head. A toothed member is rotatably received in the head and a pawl is pivotally received in the head and engaged with the toothed member. A protrusion extends from the pawl. A passage is defined through the head and communicates with an interior of the head. A driving member is received in the head and has a plate extending therefrom. A slot is defined through the plate and the protrusion of the pawl is movably engaged with the slot. A first engaging member is located on the driving member and a bar movably extends through the passage and has a second engaging member which is engaged with the first engaging member.

The primary object of the present invention is to provide a ratchet tool that has a control bar directly or indirectly pivots the pawl to engage with the toothed member. The pawl can be pivoted precisely and reliably.

The present invention will become more obvious from the following description when taken in connection with the accompanying drawings which show, for purposes of illustration only, several preferred embodiments in accordance with the present invention.

DETAILED DESCRIPTION OF THE PREFERRED EMBODIMENTS

Figure 1:
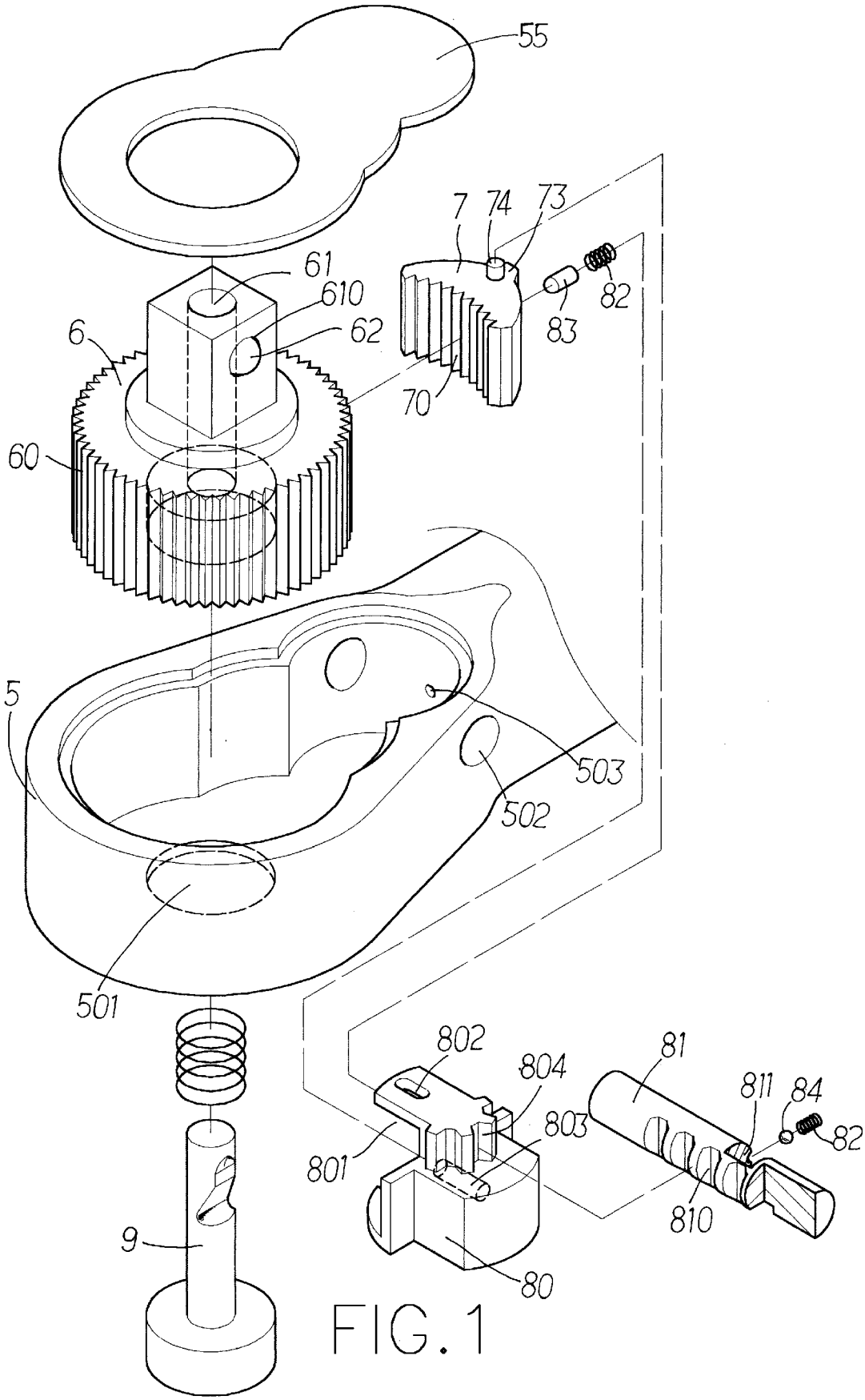
FIG. 1 is an exploded view to show a ratchet tool of the present invention.
Figure 2:
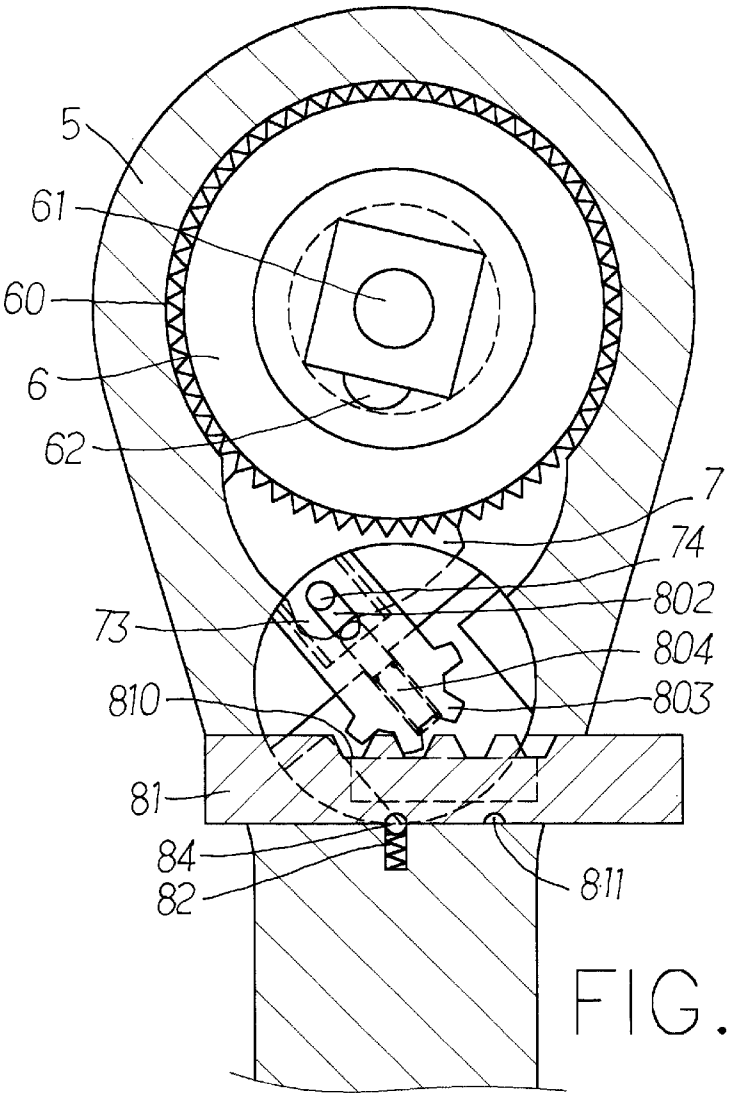
FIGS. 2 and 3 respectively show the pawl is pivoted by pushing the bar of the ratchet tool of the present invention.
Figure 3:
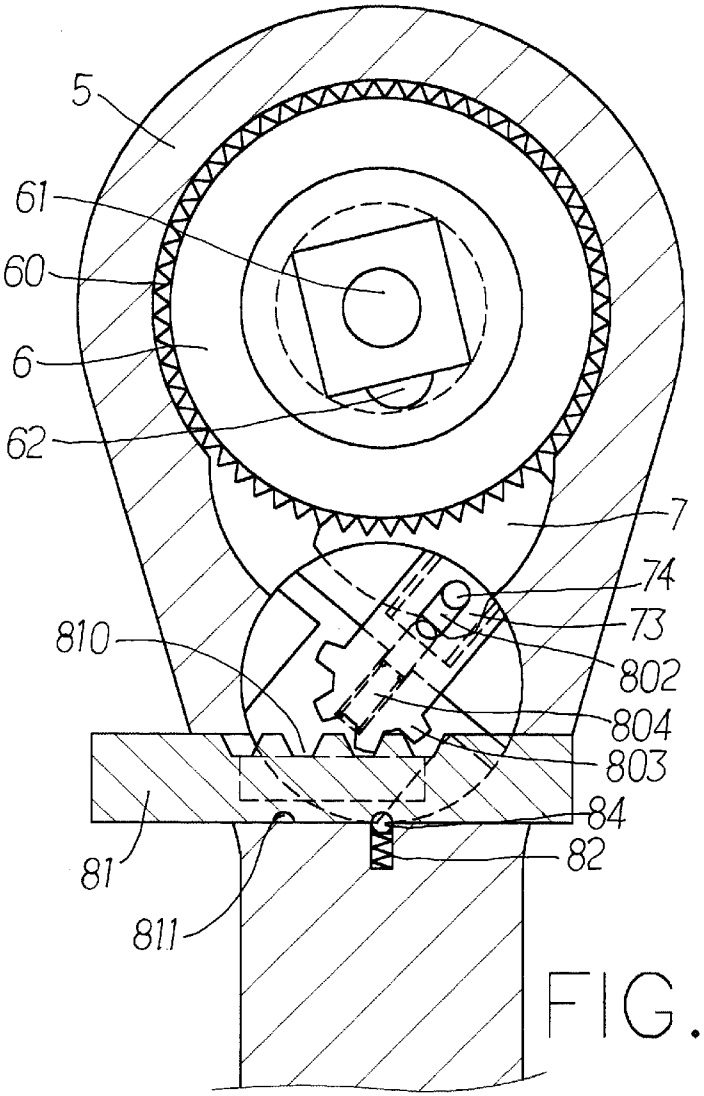
Figure 5:
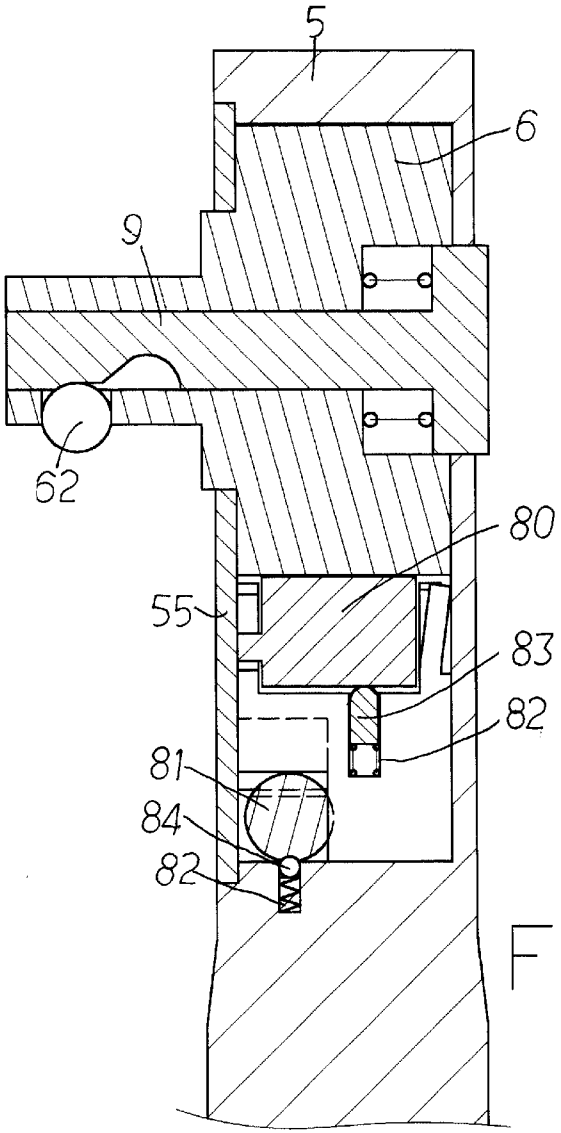
FIG. 5 is a side cross sectional view to show the ratchet tool of the present invention.
Figure 4:
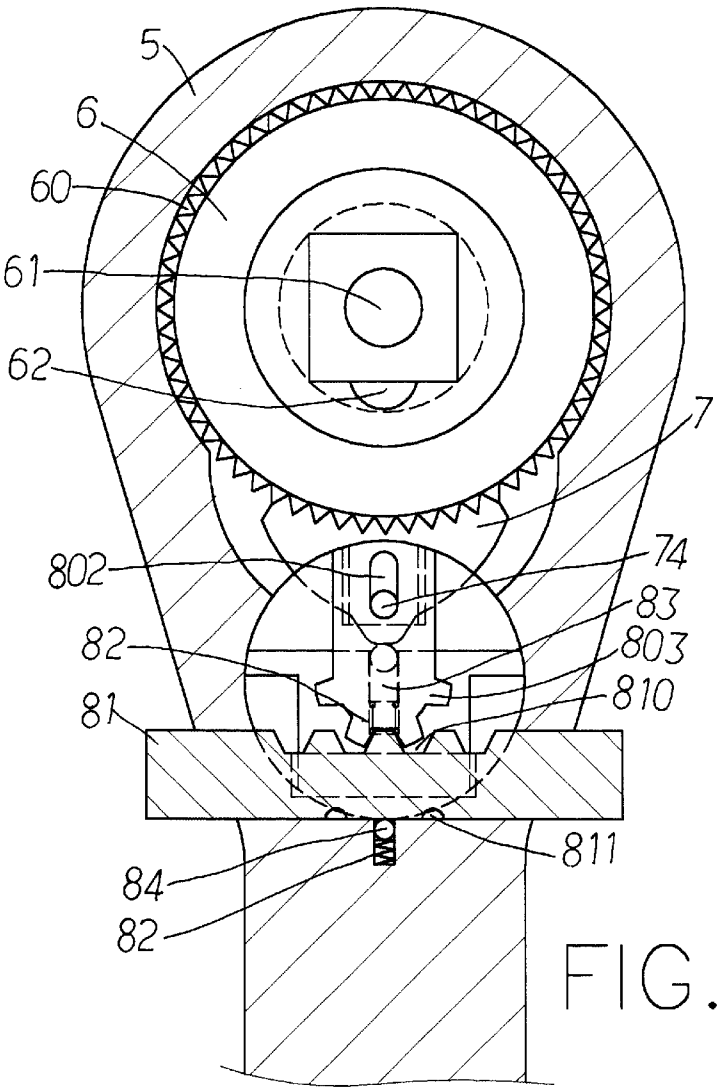
FIG. 4 shows the bar of the ratchet tool is located at a neutral position.

Referring to FIGS. 1 to 5, the ratchet tool of the present invention comprises a head 5 having an upper cover 55 and a lower cover through a hole 501 is defined. A toothed member 6 having peripheral teeth 60 is rotatably received in the head 5 and an engaging shaft extends from the toothed member 6. A passage 61 is defined through the shaft and the toothed member 6 so that a push rod 9 is movably received in the passage 61 via the hole 501. A ball 62 is engaged with a hole 610 defined in a surface of the engaging shaft and is received in a notch in the push rod 9 when pushing the push rod 9. A pawl 7 is pivotally received in the head 5 and has a toothed surface 70 engaged with the toothed member 6. A protrusion 74 extends from the pawl 7. A passage 502 is defined through the head 10 and communicates with an interior of the head 5. A driving member 80 is received in the head 5 and has a plate 801 extending therefrom. A slot 802 is defined through the plate 801 and the protrusion 74 of the pawl 7 is movably engaged with the slot 802. A first engaging member such as first teeth 804 in this embodiment are located on the driving member 80. A notch 803 is defined in the driving member 80 and a position pin 83 a spring 82 are respectively received in the notch 803. The position pin 83 is engaged with a rear end 73 of the pawl 7.

A bar 81 movably extends through the passage 502 and has a second engaging member which includes second teeth 810 engaged with the first teeth 804. The bar 81 has two dents 811 defined in an outer periphery thereof and a recess 503 is defined in an inner periphery of the head 5. A ball 84 and a spring 82 are received in the recess 503 and the ball 84 is engaged with one of the two dents 811. The bar 81 can be moved to rotate the driving member 80 so as to pivot the pawl 7 to decide which direction of rotation is effective to rotate the toothed member 6.

Figure 6:
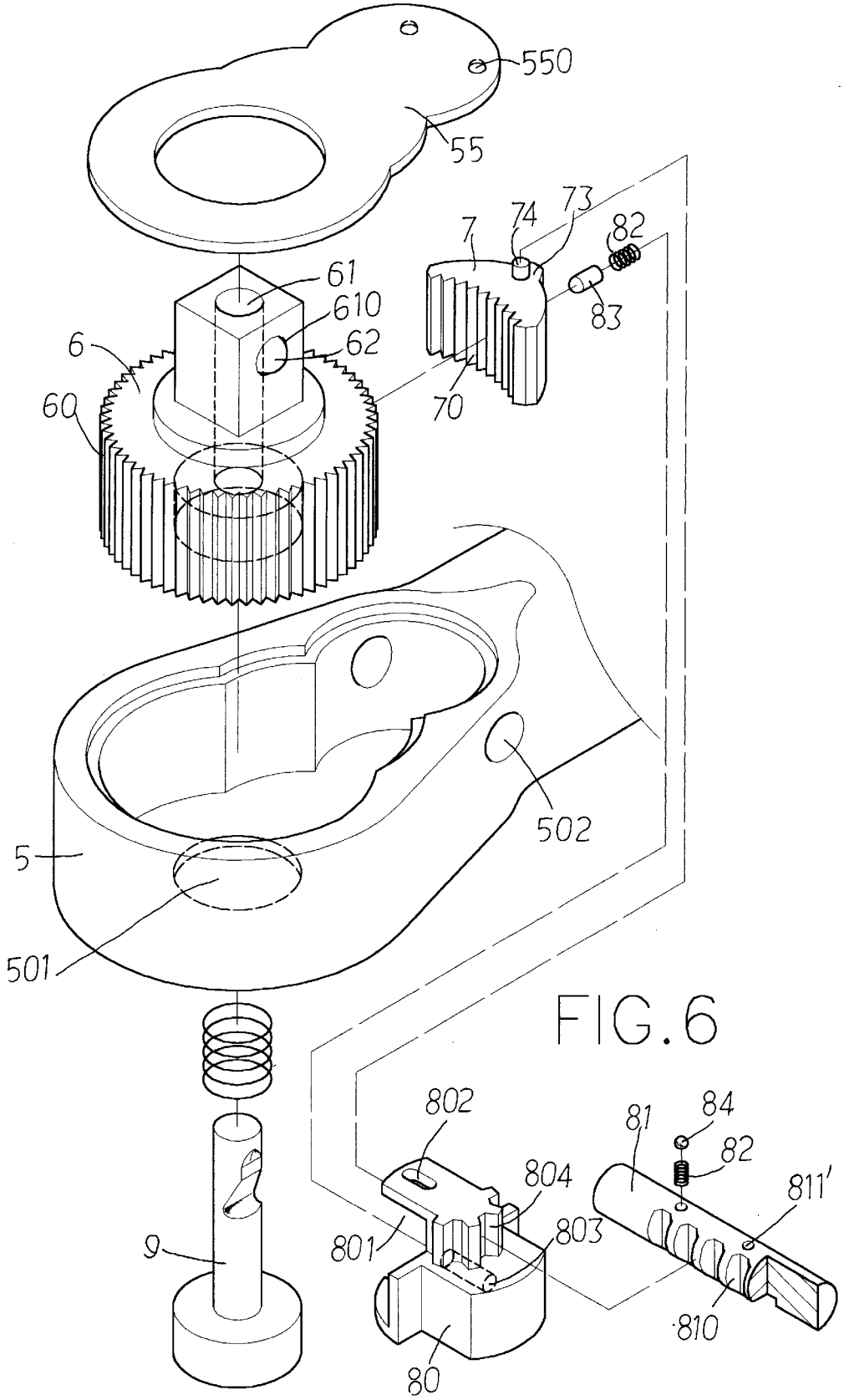
FIG. 6 is an exploded view to show an embodiment of the structure for positioning the bar.

FIG. 6 shows that the two dents 811 are replaced by two receiving holes 811' and one of the two receiving holes 811' has a ball 84 and a spring 82 received therein. The upper cover 55 has two concavities 550 and the ball 84 is engaged with one of the two concavities 550 when pushing the bar 81.

Figure 7:
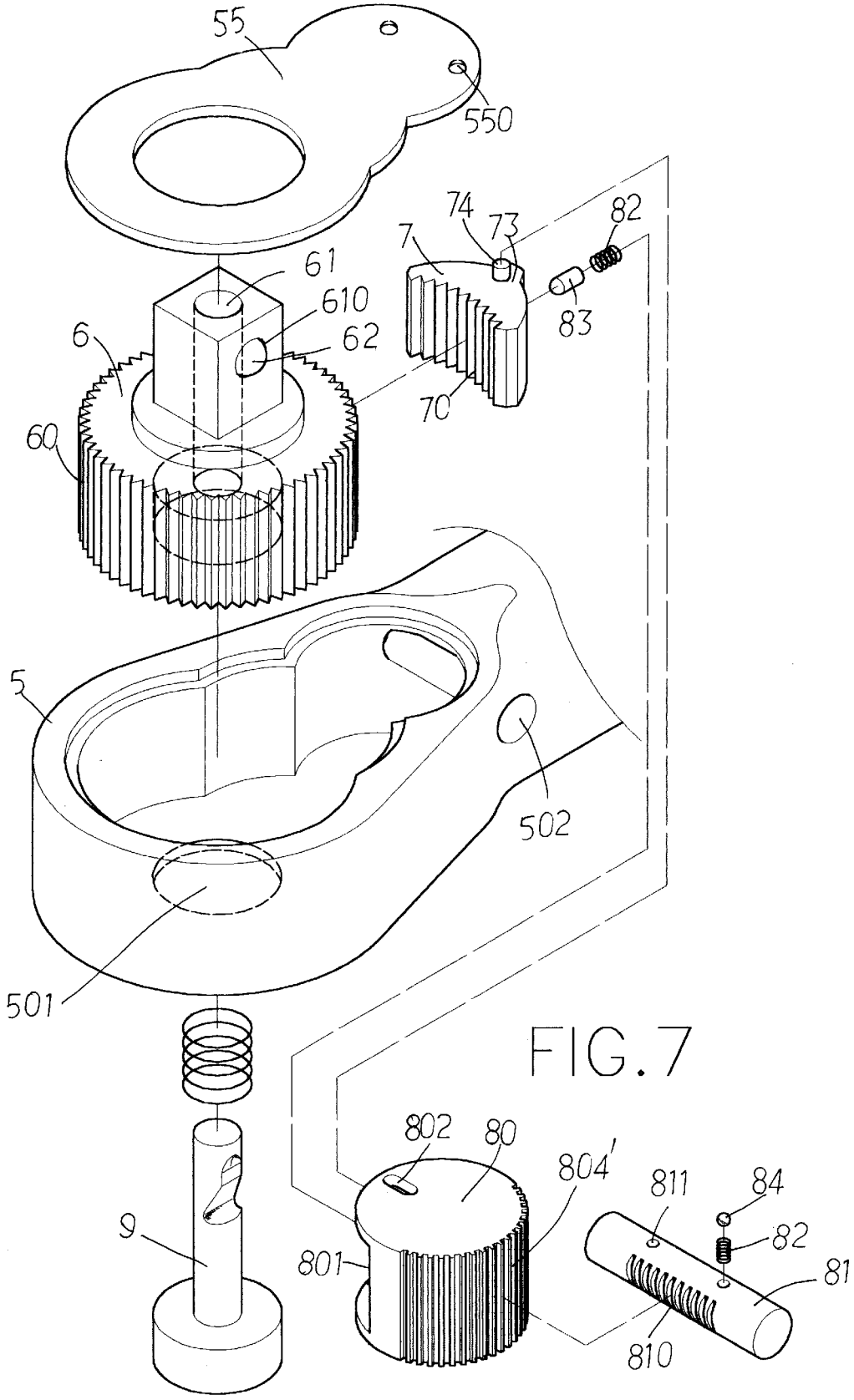
FIG. 7 is an exploded view to show an embodiment of the driving member of the present invention.

FIG. 7 shows that the driving member 80 is a cylindrical member and the second teeth 804' are defined in an outer periphery thereof and the bar 81 is a rack which is engaged with the second tooth 804'.

Figure 8:
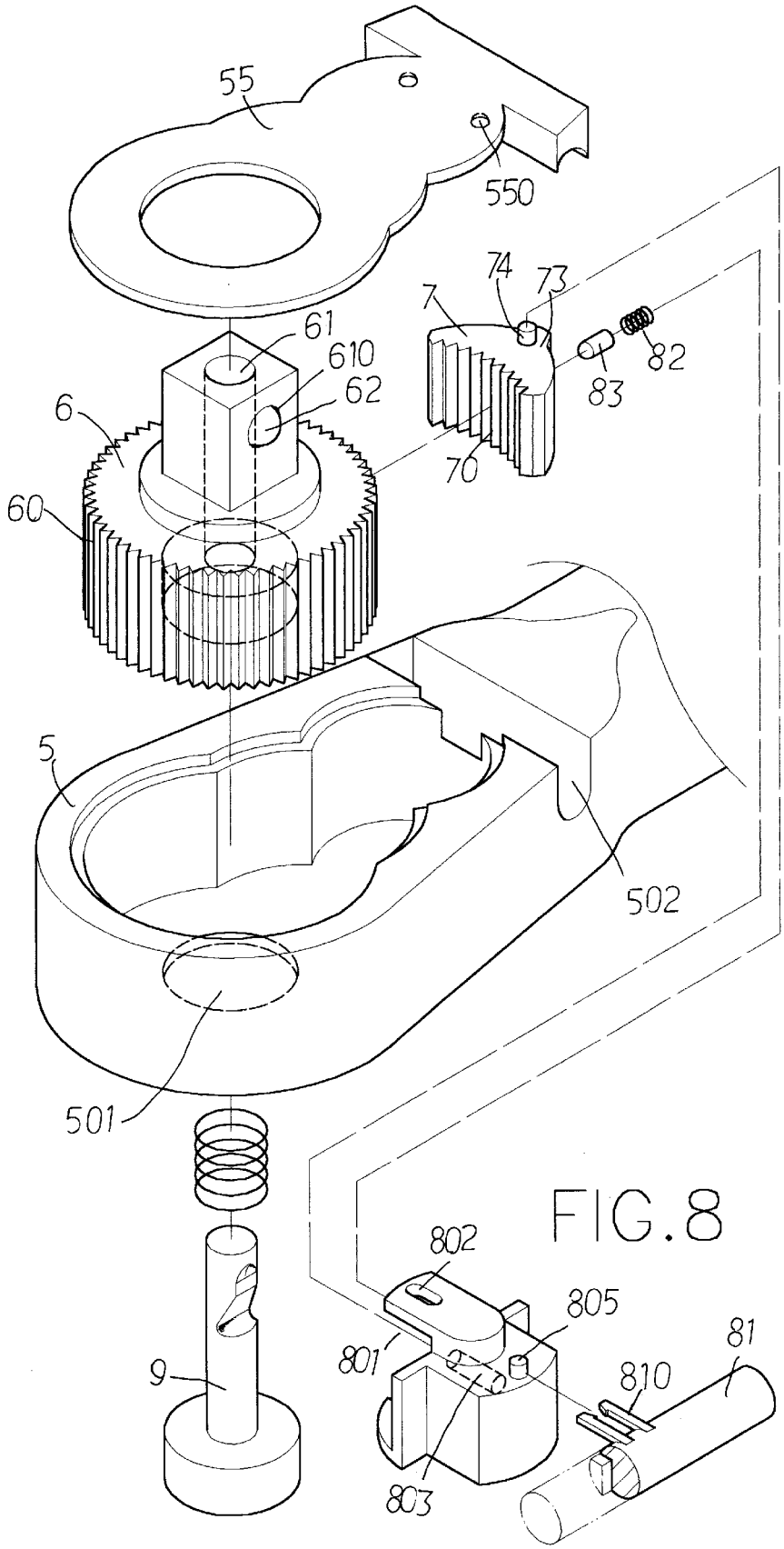
FIG. 8 is an exploded view to show an embodiment of the driving member and the bar of the present invention.
Figure 9:
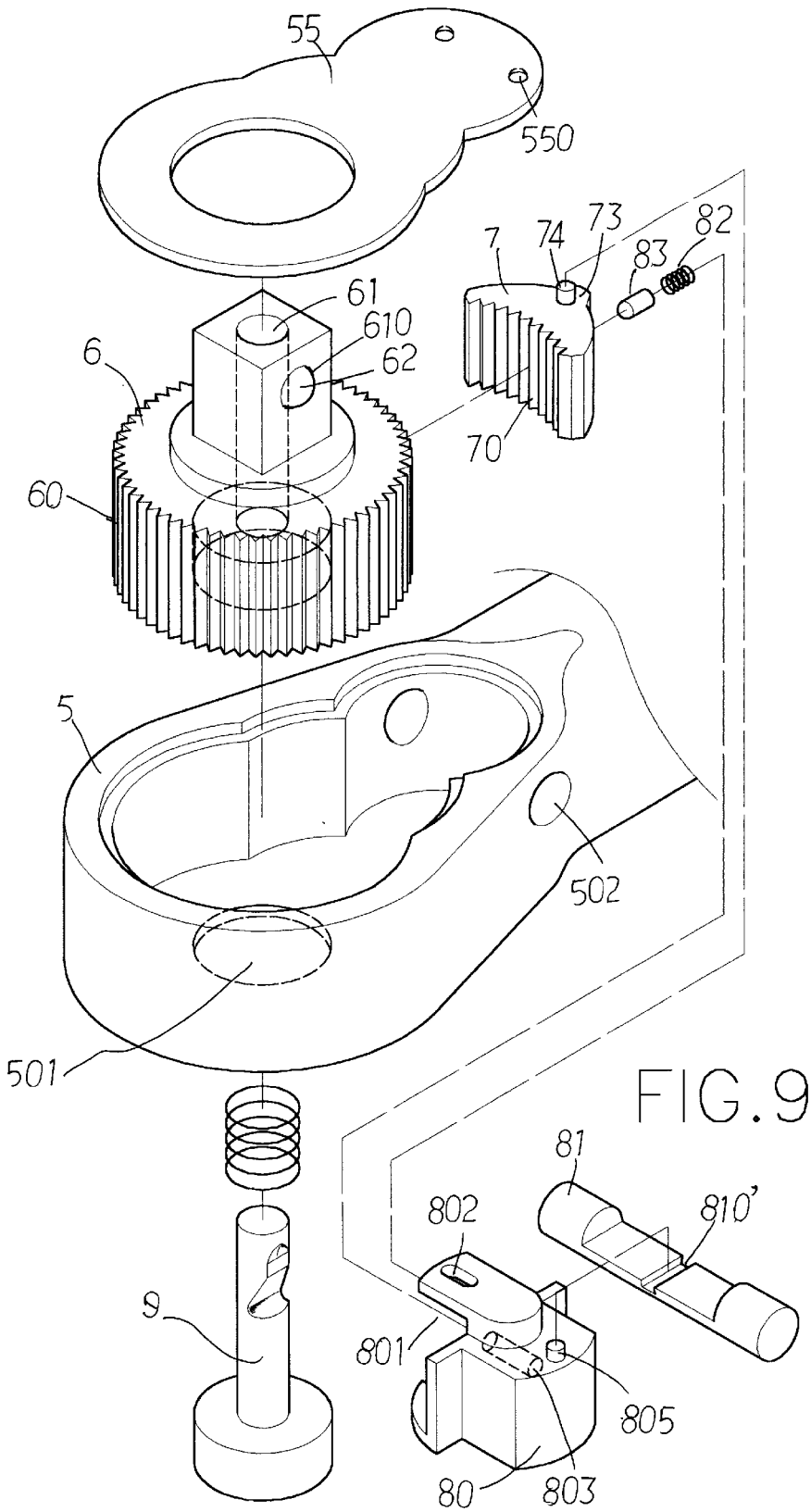
FIG. 9 is an exploded view to show an embodiment of the driving member and the bar of the present invention.

FIG. 8 shows that the first engaging member is a pin 805 and the second engaging member are two guide rods 810 between which the pin 805 is engaged. FIG. 9 shows that the first engaging member is a pin 805 and the second engaging member is a groove 810' defined in the bar 81. The pin 805 is engaged with the groove 810'.

Figure 10:
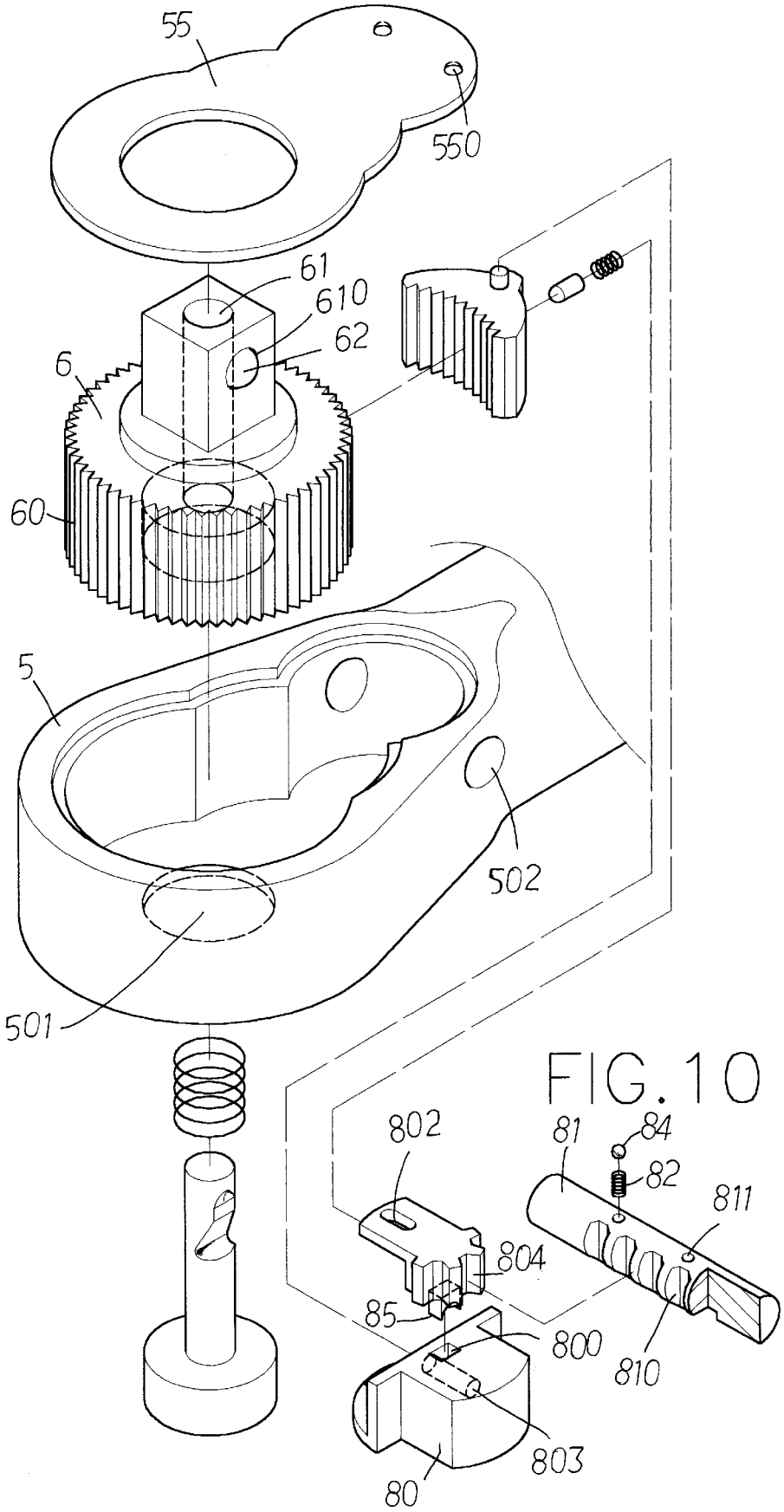
FIG. 10 is an exploded view to show an embodiment of the driving member and the bar of the present invention.

FIG. 10 shows that the plate and the first teeth 804 are assembled to the body of the driving member 80, wherein an insertion 85 extends from an underside of the combination of the plate and the first teeth 804 and a hole 800 is defined in a top of the body of the driving member 80 so as to receive the insertion 85.

Figure 11:
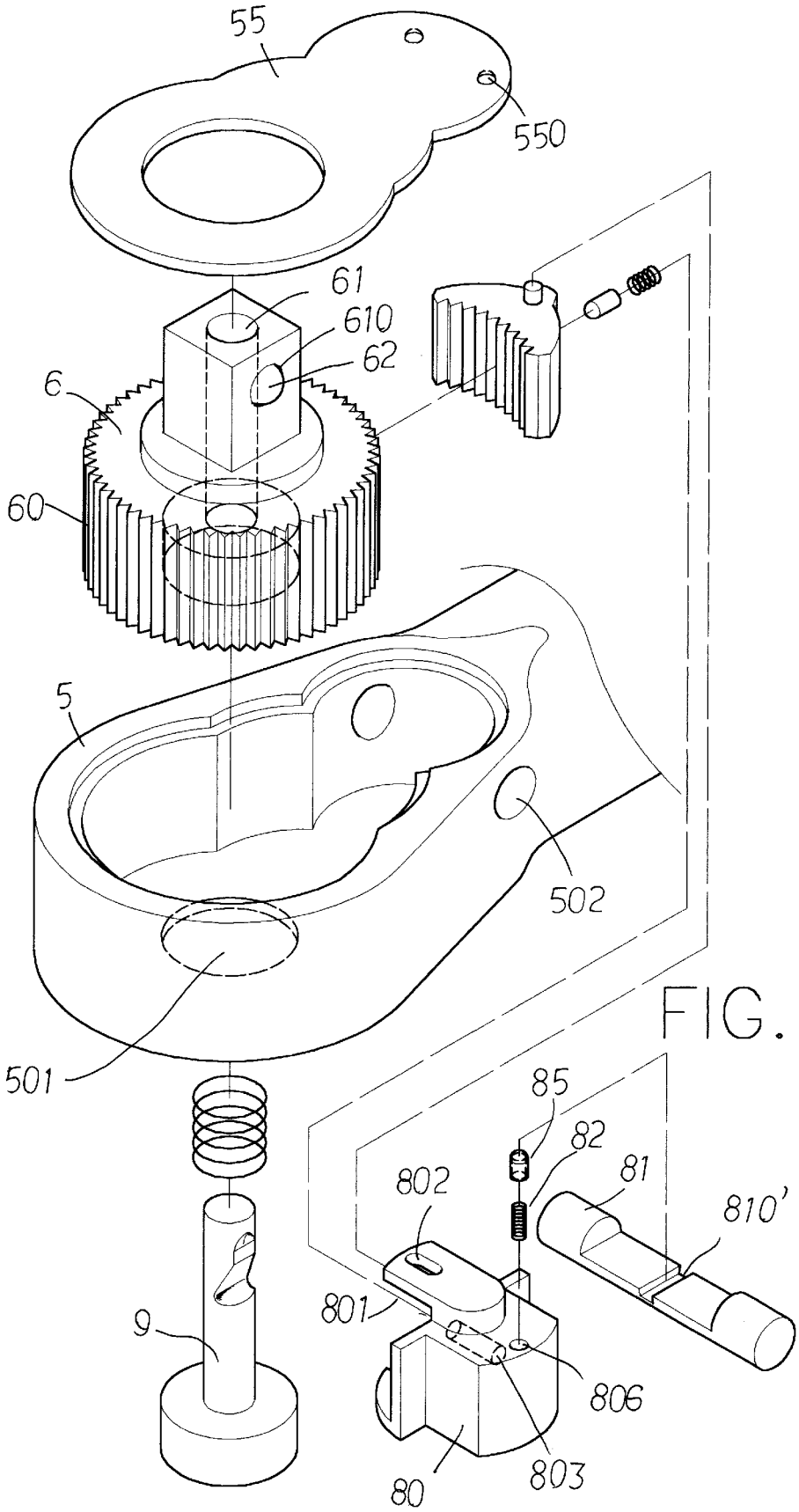
FIG. 11 is an exploded view to show an embodiment of the driving member and the bar of the present invention.

FIG. 11 shows that the first engaging member includes a ball 85 biased by a spring 82 and both of which are received in a hole 806 defined in a top of the driving member 80. The second engaging member is a groove 810' defined in the bar 81 so that the ball 85 is engaged with the groove 810'.

Figure 12:
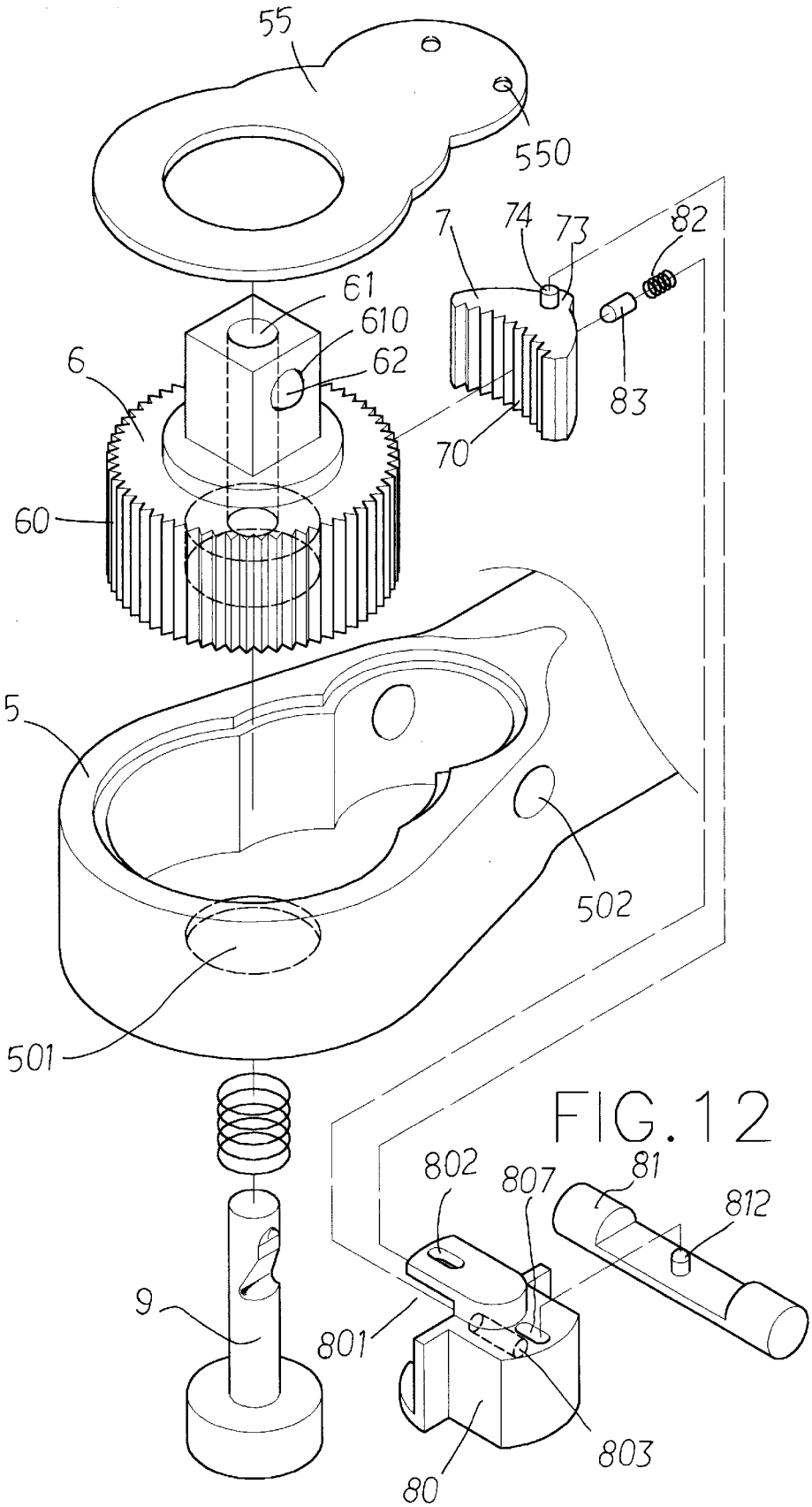
FIG. 12 is an exploded view to show an embodiment of the driving member and the bar of the present invention.
Figure 13:
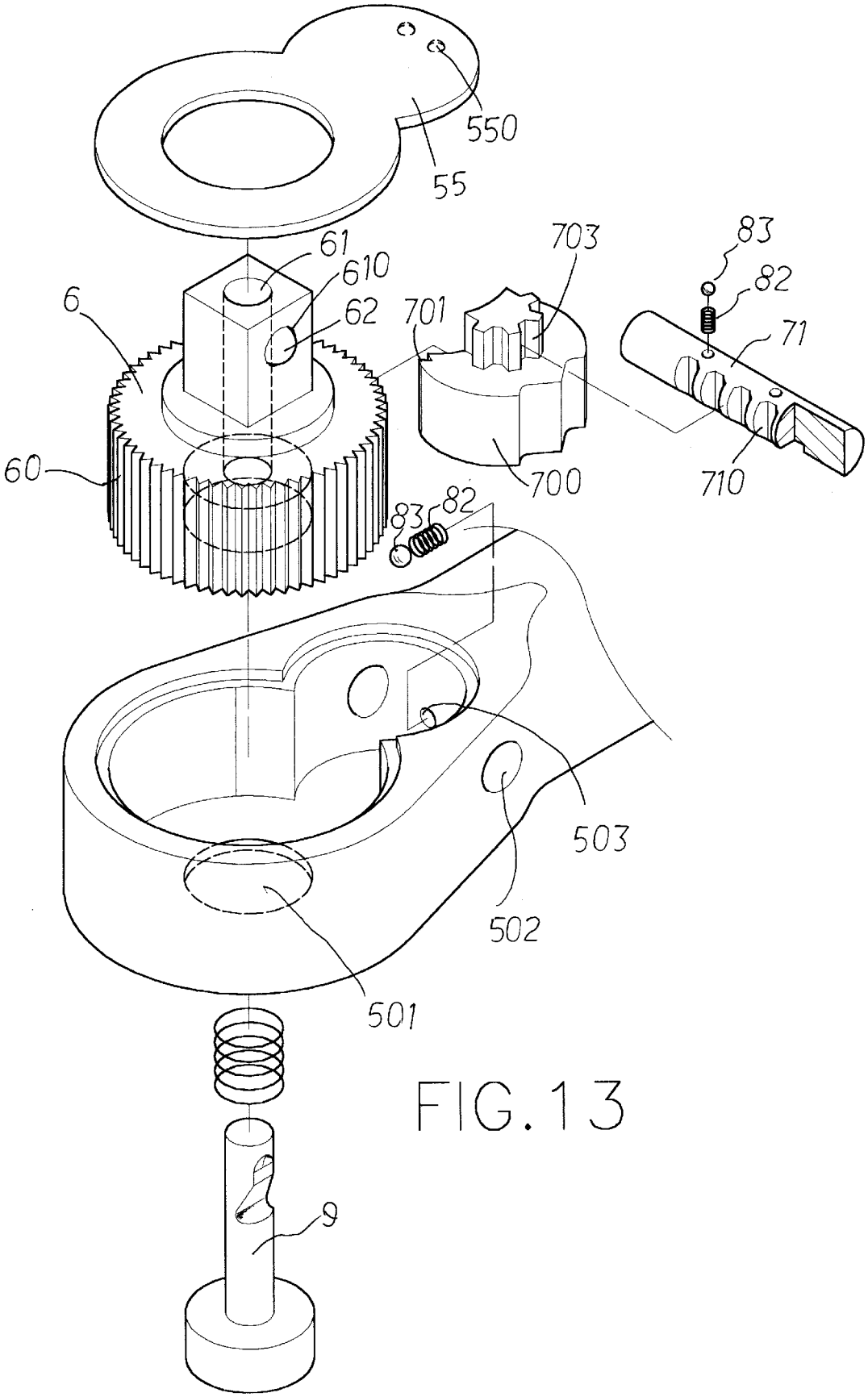
FIG. 13 is an exploded view to show another embodiment of the ratchet tool of the present invention.
Figure 14:
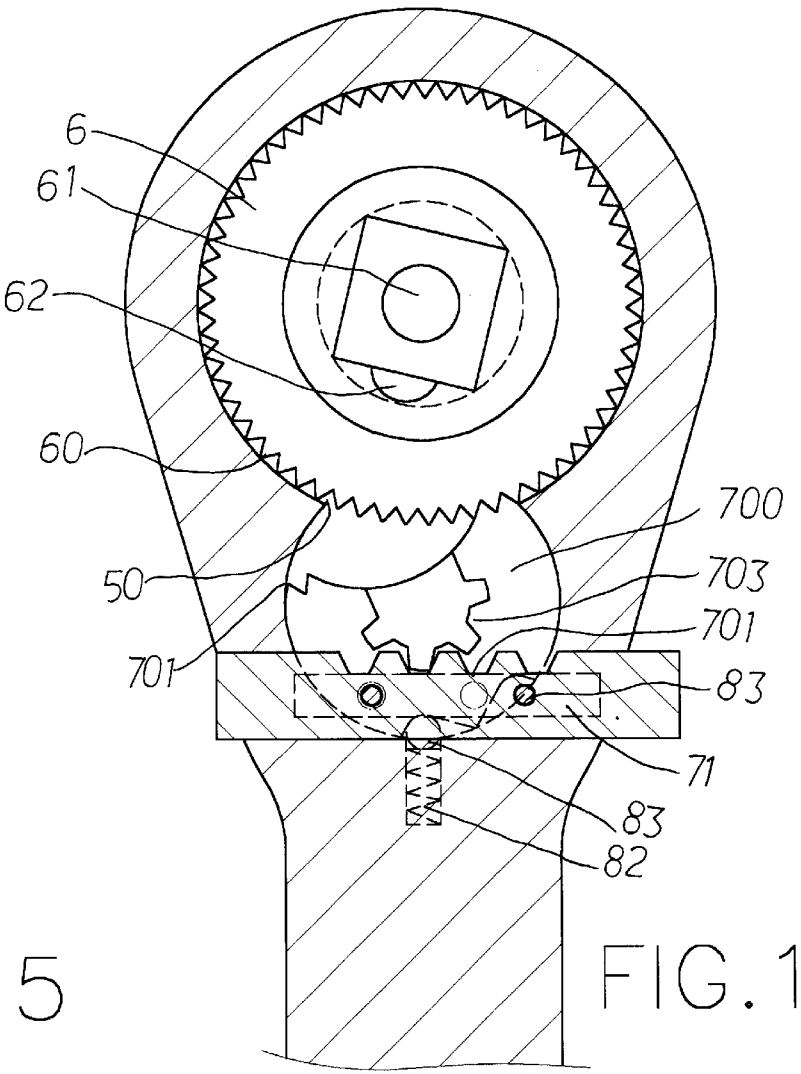
FIGS. 14 and 15 respectively show the pawl is pivoted by pushing the bar of the ratchet tool as shown in FIG. 13.
Figure 15:
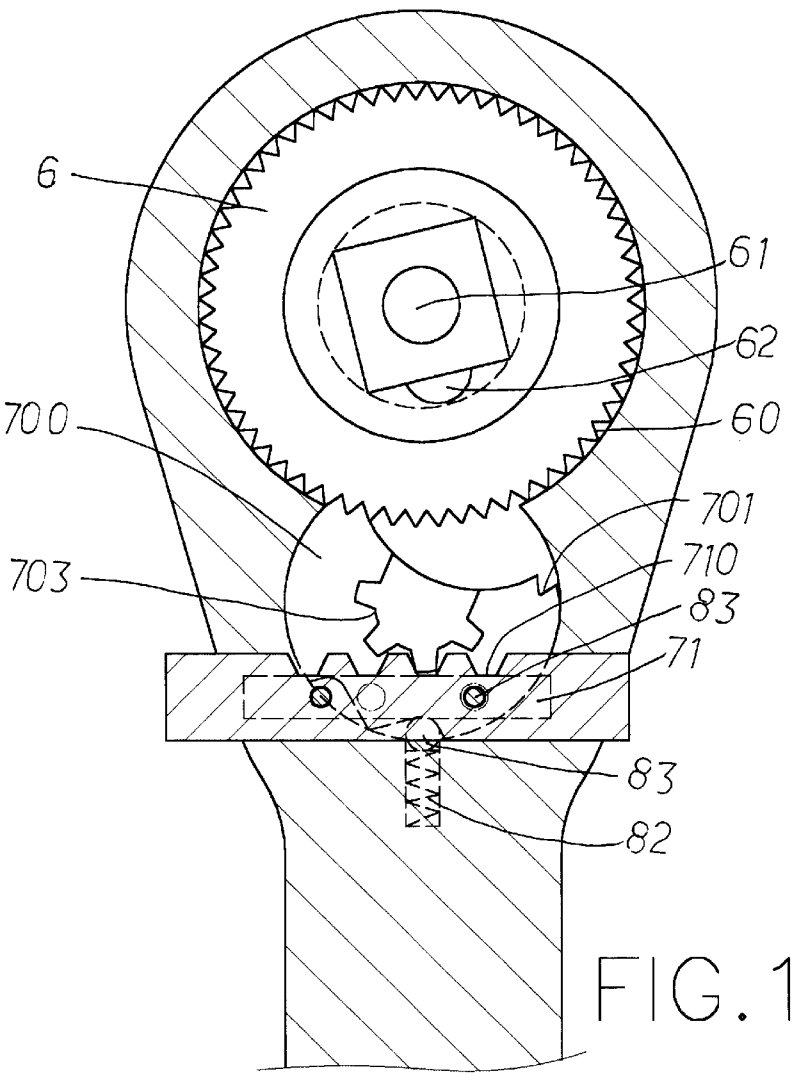
Figure 17:
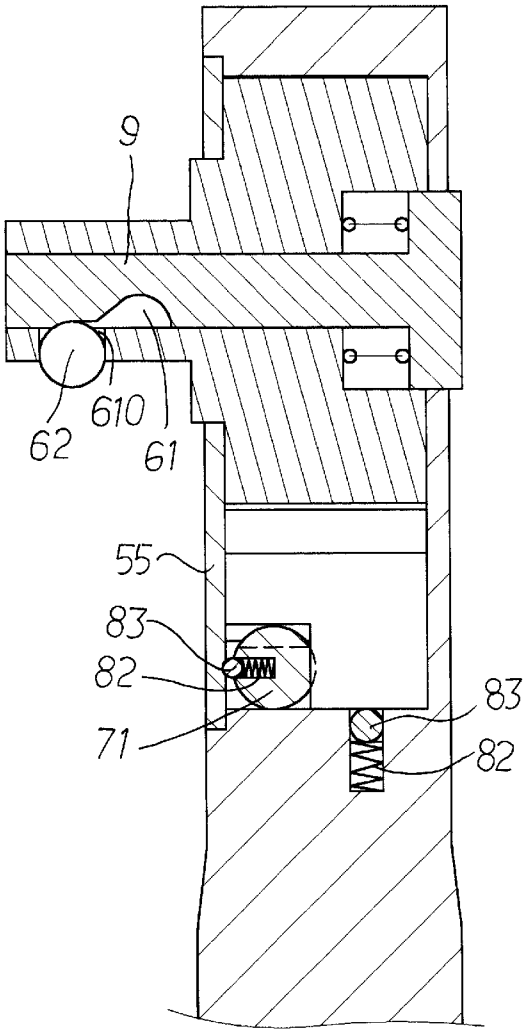
FIG. 17 is a side cross sectional view to show the ratchet tool of the present invention as shown in FIG. 13.
Figure 16:
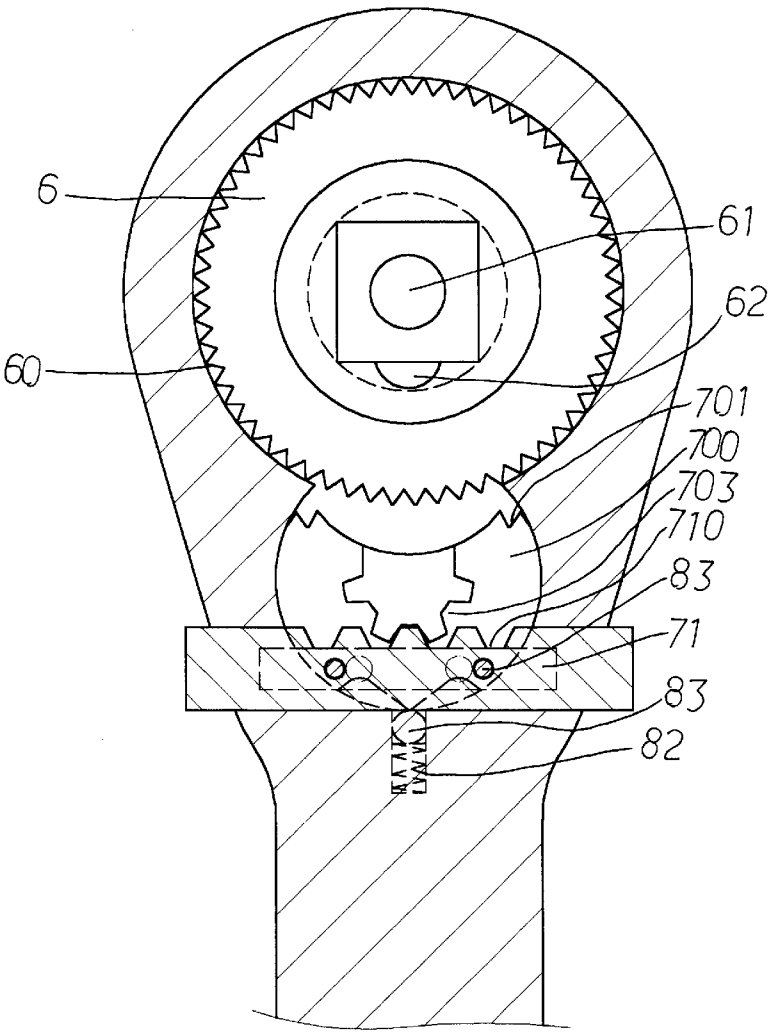
FIG. 16 shows the bar of the ratchet tool as shown in FIG. 13 is located at a neutral position.

FIG. 12 shows that the first engaging member is an elongate hole 807 and the second engaging member is a boss 812 extending from the bar 81. The boss 812 is movably engaged with the elongate hole 807.

FIGS. 13 to 17 show another embodiment of the ratchet tool of the present invention and the embodiment has a similar structure as that shown in FIG. 1 except that the driving member 80 in FIG. 1 is not used in this embodiment and the first engaging member 703 is directly connected to the pawl 700 so as to be cooperated with the bar 71. The pawl 700 has two teeth 701 defined in two ends of the pawl 700. The first engaging member includes first teeth 703 which is engaged with the second teeth 710 defined in the bar 71.

Figure 18:
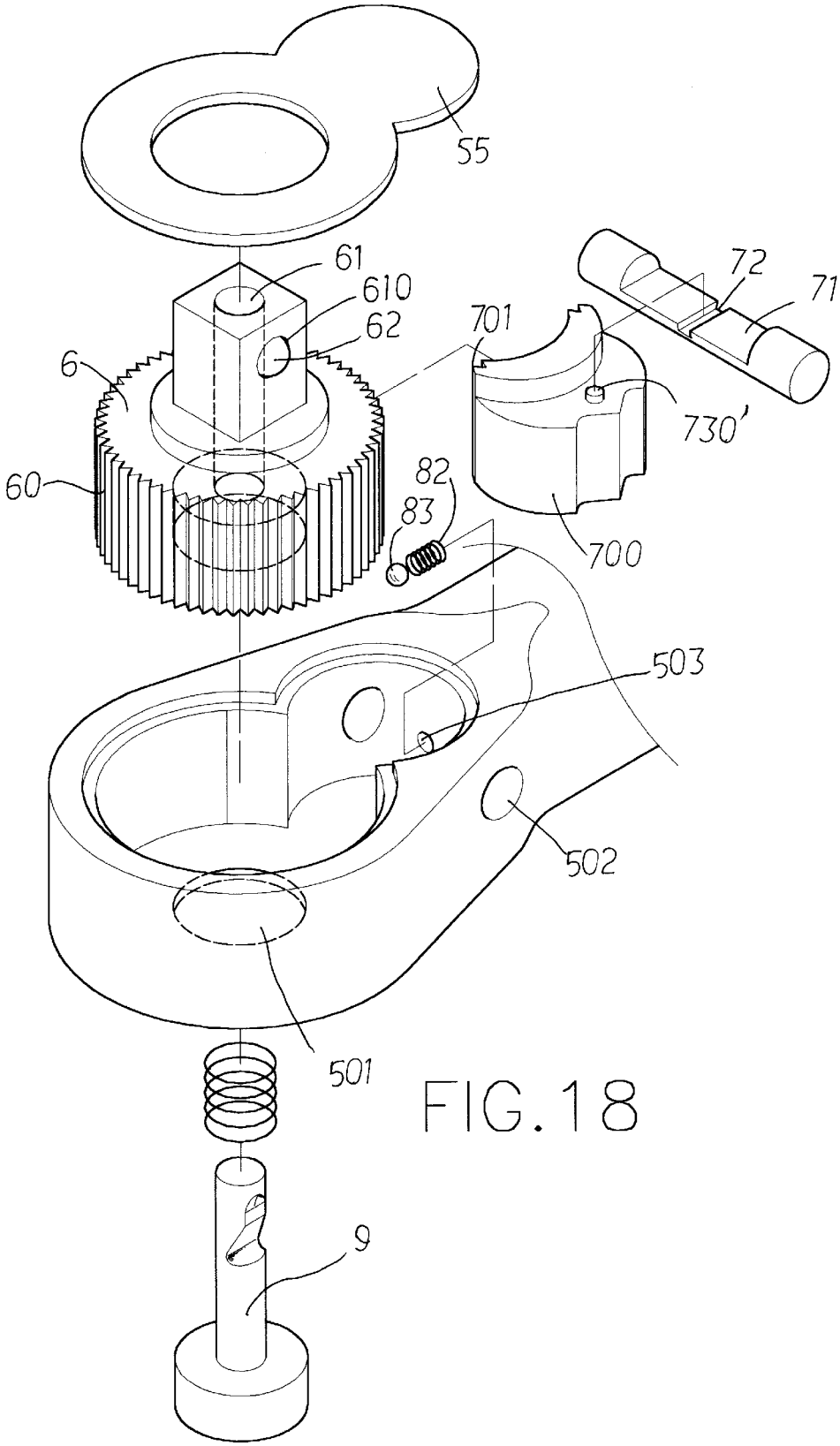
FIG. 18 is an exploded view to show an embodiment of the driving member and the bar of the ratchet tool.
Figure 19:
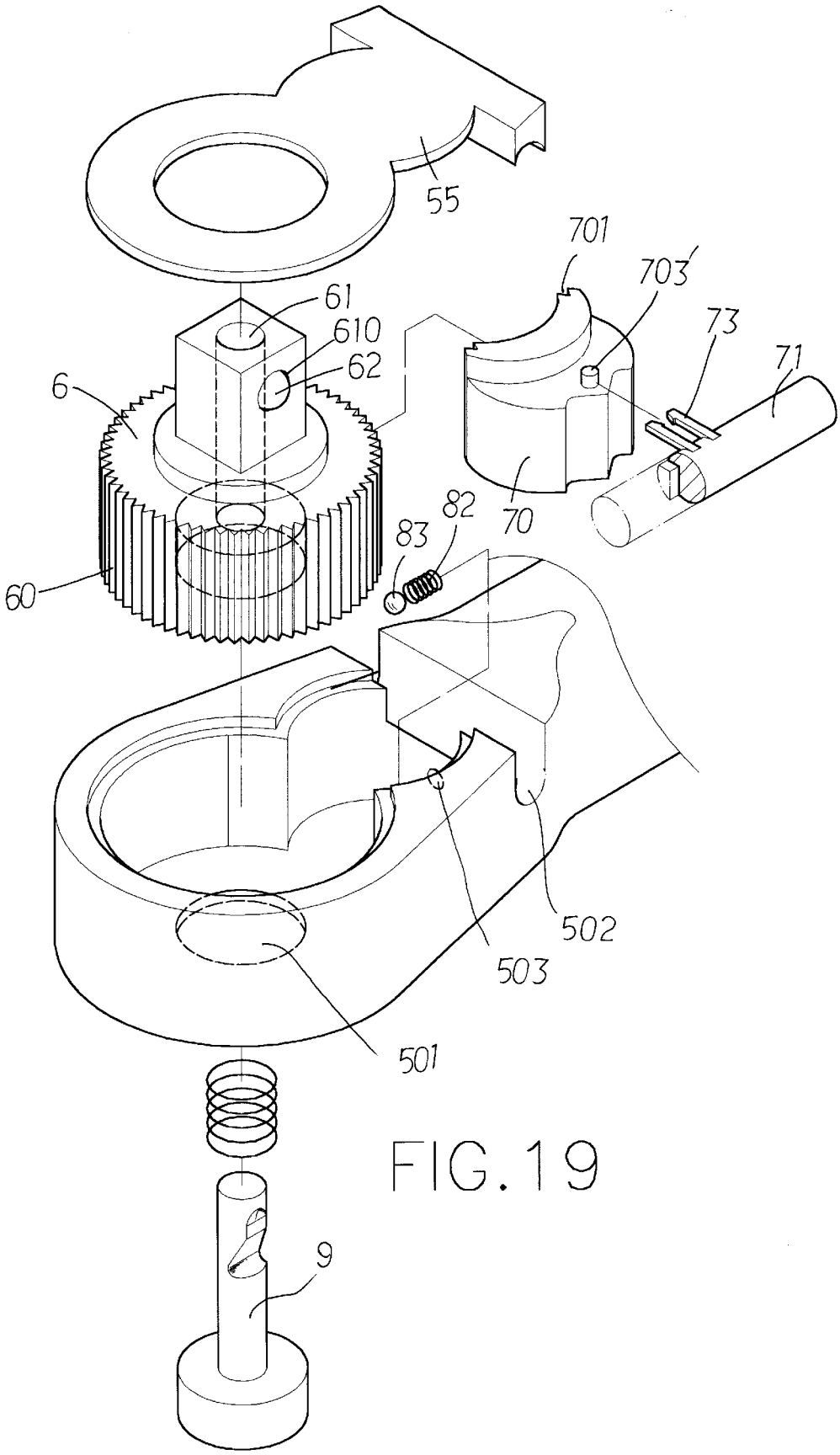
FIG. 19 is an exploded view to show an embodiment of the driving member and the bar of the ratchet tool.

FIG. 18 shows that the first engaging member is a pin 703' and the second engaging member is a groove 72 defined in the bar 71. The pin 703' is engaged with the groove 72. FIG. 19 shows that the first engaging member is a pin 703' and the second engaging member includes two guide rods 73 between which the pin 703' is engaged.

Figure 20:
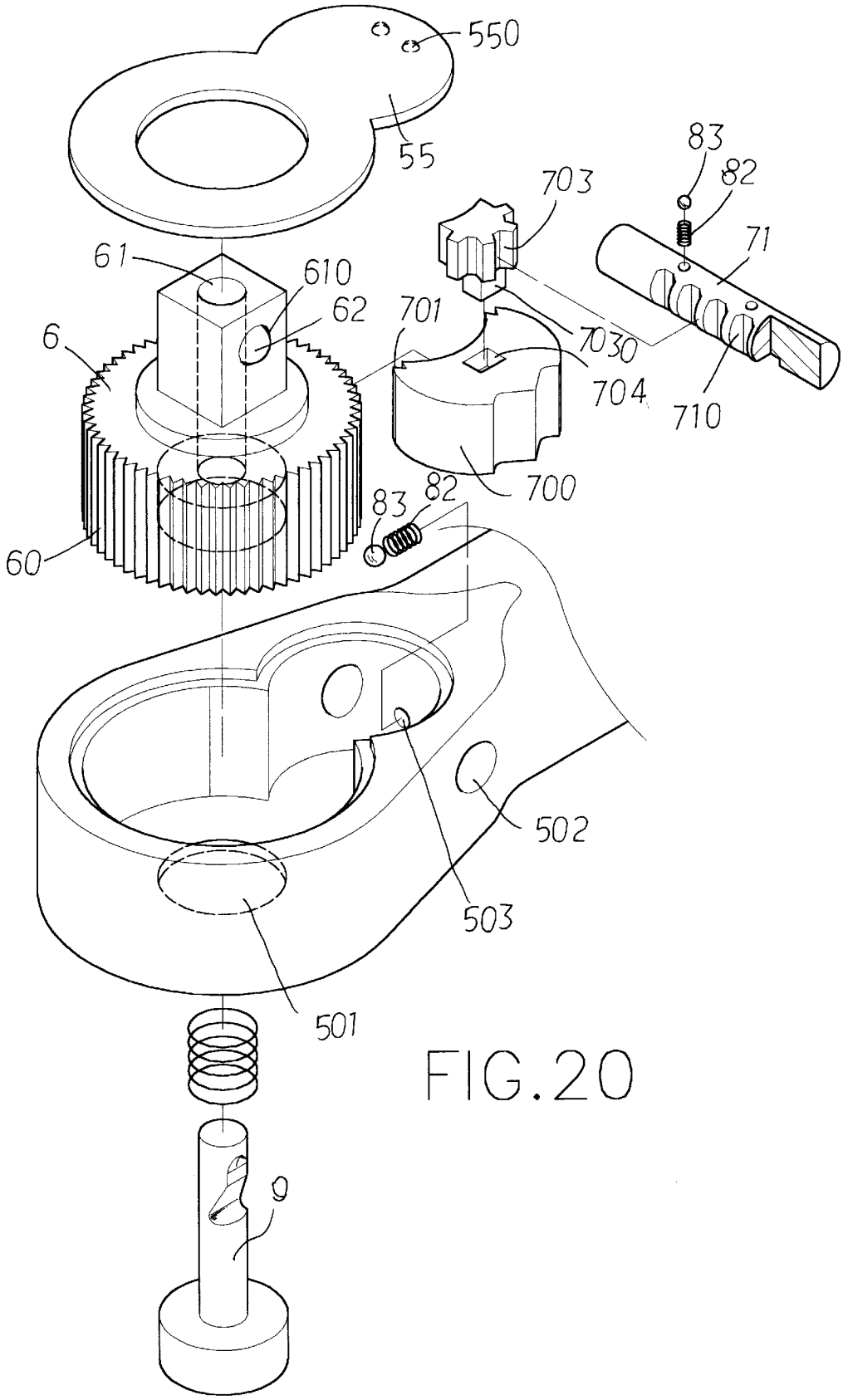
FIG. 20 is an exploded view to show an embodiment of the driving member and the bar of the ratchet tool.

FIG. 20 shows that the member having first teeth 73 and the pawl 700 are assembled by inserting an insertion 7030 extending from the member having the first teeth 73 into a hole 704 defined in a top of the pawl 700.

Figure 21:
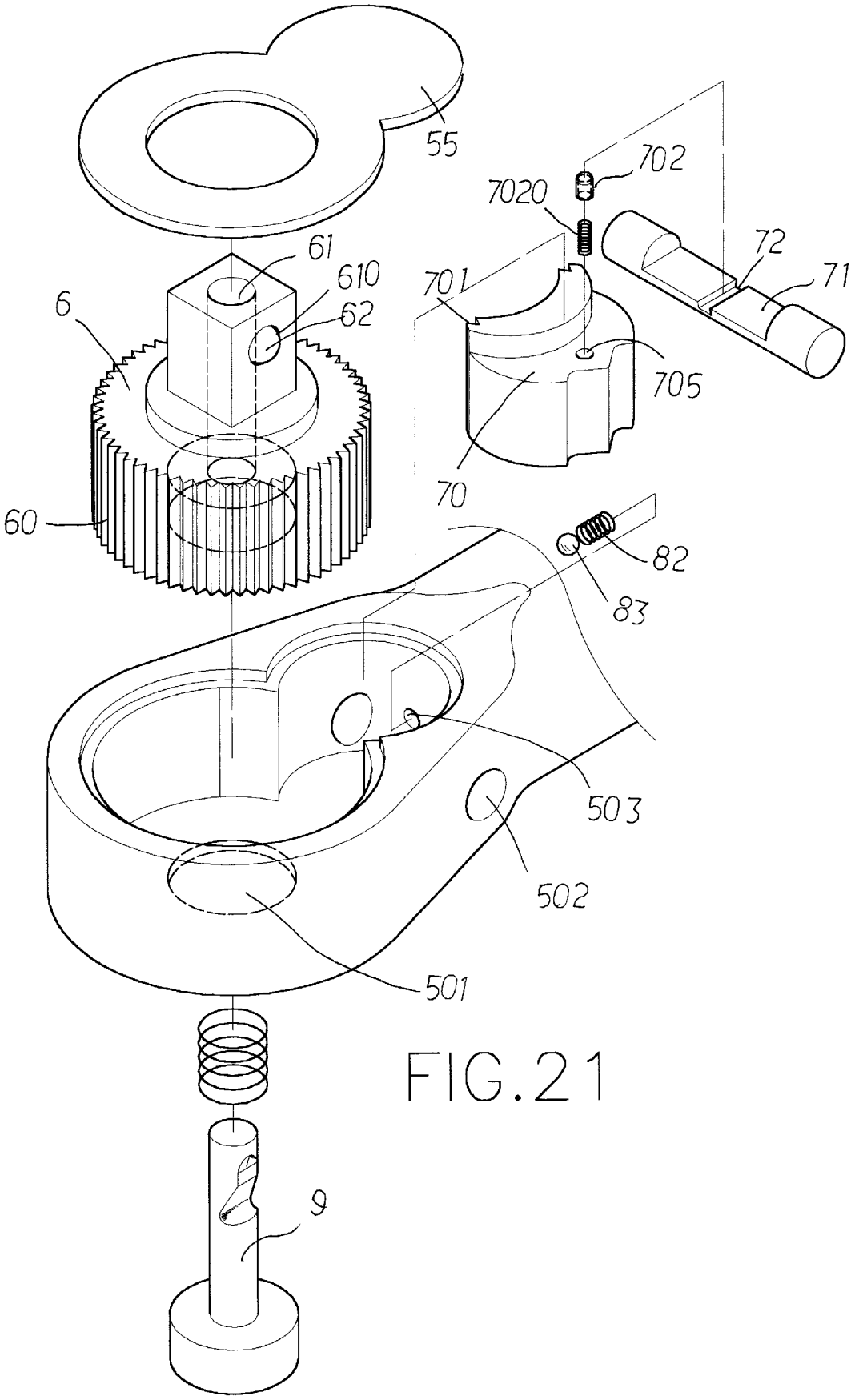
FIG. 21 is an exploded view to show an embodiment of the driving member and the bar of the ratchet tool.
Figure 22:
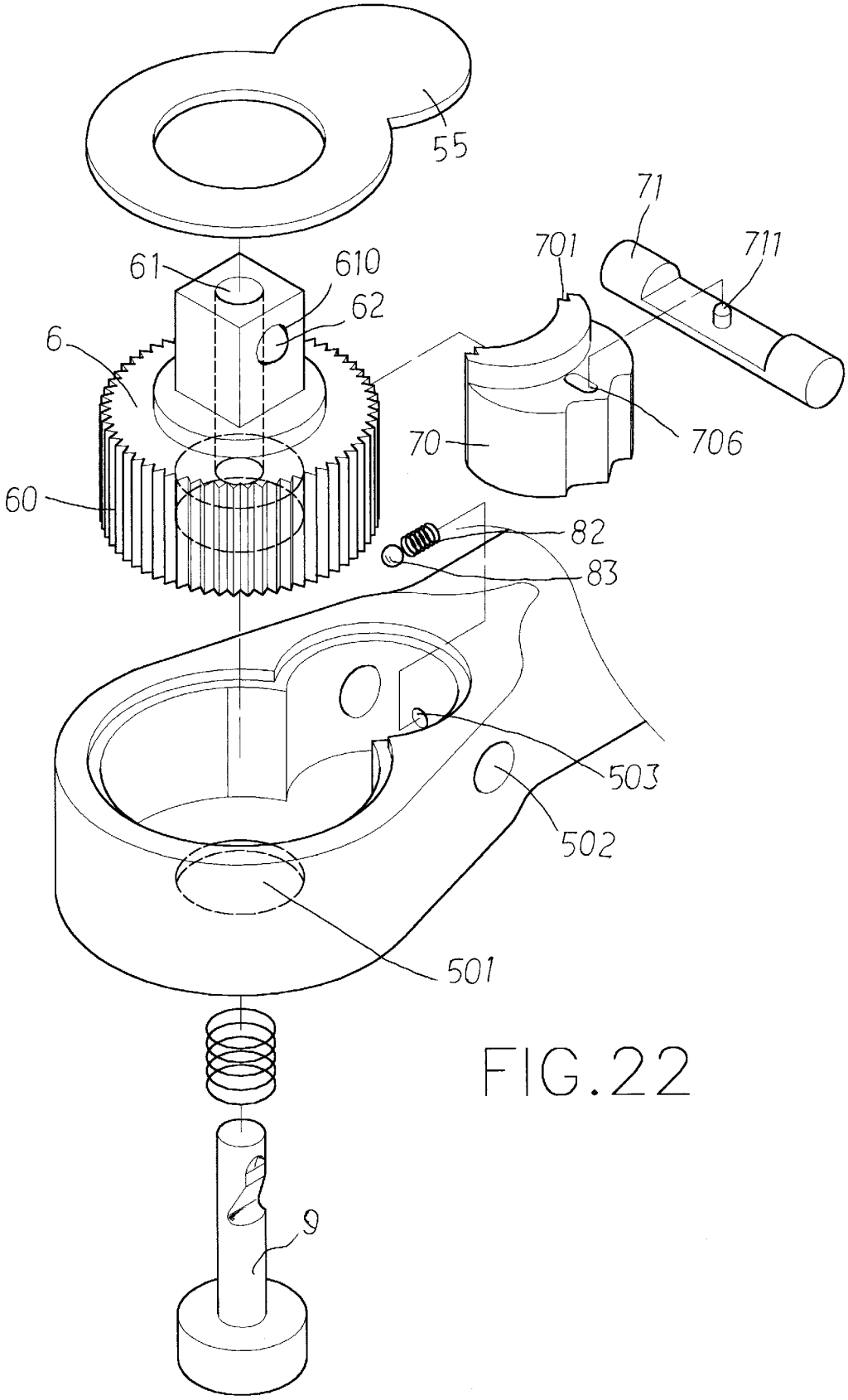
FIG. 22 is an exploded view to show an embodiment of the driving member and the bar of the ratchet tool.

FIG. 21 shows that the first engaging member includes a ball 702 biased by a spring 7020 and both of which are received in a hole 705 defined in a top of the pawl 70. The second engaging member is a groove 72 defined in the bar 71 so that the ball 702 is engaged with the groove 72. FIG. 22 shows that the first engaging member is an elongate hole 706 and the second engaging member is a boss 711 extending from the bar 71. The boss 711 is movably engaged with the elongate hole 706.

While we have shown and described various embodiments in accordance with the present invention, it should be clear to those skilled in the art that further embodiments may be made without departing from the scope of the present invention.

What is claimed is:

1. A ratchet tool comprising:

a head having two covers respectively connected to sides of said head, a toothed member rotatably received in said head, a pawl pivotally received in said head and engaged with said toothed member, a protrusion extending from said pawl, a passage defined through said head and communicating with an interior of said head;

a driving member received in said head and having a plate extending therefrom, a slot defined through said plate and said protrusion of said pawl movably engaged with said slot, a first engaging member located on said driving member, and a bar movably extending through said passage and having a second engaging member which is engaged with said first engaging member.

2. The tool as claimed in claim 1 wherein said first engaging member includes first teeth and said second engaging member includes second teeth.

3. The tool as claimed in claim 1 wherein said first engaging member is a pin and said second engaging member are two guide rods between which said pin is engaged.

4. The tool as claimed in claim 1 wherein said first engaging member is a pin and said second engaging member is a groove defined in said bar, said pin engaged with said groove.

5. The tool as claimed in claim 1 wherein said first engaging member includes a ball biased by a spring and said second engaging member is a groove defined in said bar, said ball engaged with said groove.

6. The tool as claimed in claim 1 wherein said first engaging member is an elongate hole and said second engaging member is a boss extending from said bar, said boss movably engaged with said elongate hole.

7. The tool as claimed in claim 1 wherein said bar has two dents defined in an outer periphery thereof and a recess is defined in an inner periphery of said head, a ball and a spring received in said recess and said ball engaged with one of said two dents.

8. The tool as claimed in claim 1 wherein said bar has two receiving holes defined in an outer periphery thereof and one of said two receiving holes has a ball and a spring received therein, one of said covers of said head having two concavities, said ball engaged with one of said two concavities.

9. The tool as claimed in claim 1 further comprising a notch defined in said driving member and a position pin a spring respectively received in said notch, said position pin engaged with a rear end of said pawl.

10. A ratchet tool comprising:

a head having two covers respectively connected to sides of said head, a toothed member rotatably received in said head, a pawl pivotally received in said head and engaged with said toothed member, a first engaging member having first teeth and connected to said pawl, a passage defined through said head and communicating with an interior of said head, and a bar movably extending through said passage and having a second engaging member which has second teeth which are engaged with said first teeth of said first engaging member.

11. The tool as claimed in claim 10 wherein said first engaging member is a pin and said second engaging member are two guide rods between which said pin is engaged.

12. The tool as claimed in claim 10 wherein said first engaging member is a pin and said second engaging member is a groove defined in said bar, said pin engaged with said groove.

13. The tool as claimed in claim 10 wherein said first engaging member includes a ball biased by a spring and said second engaging member is a groove defined in said bar, said ball engaged with said groove.

14. The tool as claimed in claim 10 wherein said first engaging member is an elongate hole and said second engaging member is a boss extending from said bar, said boss movably engaged with said elongate hole.

15. The tool as claimed in claim 10 wherein said bar has two receiving holes defined in an outer periphery thereof and one of said two receiving holes has a ball and a spring received therein, one of said covers of said head having two concavities, said ball engaged with one of said two concavities.

* * * * *